US009551147B2

(12) United States Patent
Marstein

(10) Patent No.: US 9,551,147 B2
(45) Date of Patent: Jan. 24, 2017

(54) BUILDING BLOCK FOR WALL CONSTRUCTION

(71) Applicant: Vidar Marstein, Trondheim (NO)

(72) Inventor: Vidar Marstein, Trondheim (NO)

( * ) Notice: Subject to any disclaimer, the term of this patent is extended or adjusted under 35 U.S.C. 154(b) by 0 days.

(21) Appl. No.: 14/744,100

(22) Filed: Jun. 19, 2015

(65) Prior Publication Data

US 2016/0010329 A1 Jan. 14, 2016

(30) Foreign Application Priority Data

Jul. 11, 2014 (NO) ..... 20140884
Mar. 30, 2015 (NO) ..... 20150388

(51) Int. Cl.
*E04C 1/41* (2006.01)
*E04B 2/46* (2006.01)
(Continued)

(52) U.S. Cl.
CPC . *E04C 1/41* (2013.01); *E04B 2/46* (2013.01); *E04B 2/54* (2013.01); *E04C 1/39* (2013.01);
(Continued)

(58) Field of Classification Search
CPC ..... E04C 1/41; E04C 2/34; E04C 2/52; E04C 1/39; E04C 2/46; E04B 2/46; E04B 2/54; E04B 2002/0289; E04B 2002/0232
(Continued)

(56) References Cited

U.S. PATENT DOCUMENTS 3,353,315 A * 11/1967 Barker ..... E04C 2/22 428/167
3,380,506 A * 4/1968 Good ..... E06B 3/481 160/199
(Continued)

FOREIGN PATENT DOCUMENTS

BE 682616 12/1966
BE 1016469 A6 11/2006
(Continued)

OTHER PUBLICATIONS

Norwegian Search Report dated Jun. 26, 2015.

*Primary Examiner* — Basil Katcheves
*Assistant Examiner* — Joshua Ihezie
(74) *Attorney, Agent, or Firm* — Alix, Yale & Ristas, LLP

(57) ABSTRACT

Building block for forming a wall construction, including insulating material and vertical load-bearing walls extending from one longitudinal side towards another longitudinal side of the building block, where the insulating material is provided with recesses for accommodating and holding the load-bearing walls in position, where inner part of the insulating material and the load-bearing walls are provided with recesses for accommodating at least one longitudinal reinforcing element binding the load-bearing walls together in longitudinal direction of the building block for forming an inner core where the vertical load-bearing walls, insulating material and the at least one reinforcing element together
(Continued)

form the basic load-bearing in the building block, and that the building block includes at least one outer core formed by parts of insulating material and load-bearing walls outside the at least one reinforcing element, where the at least one outer core has supplementing and reinforcing properties for the inner core.

12 Claims, 16 Drawing Sheets

(51) Int. Cl.

| | |
|---|---|
| ***E04B 2/54*** | (2006.01) |
| ***E04C 1/39*** | (2006.01) |
| ***E04C 2/34*** | (2006.01) |
| ***E04B 2/00*** | (2006.01) |
| ***E04C 2/52*** | (2006.01) |
| ***E04C 1/40*** | (2006.01) |
| *E04B 2/02* | (2006.01) |

(52) U.S. Cl.
CPC . *E04C 1/40* (2013.01); *E04C 2/34* (2013.01); *E04C 2/46* (2013.01); *E04C 2/52* (2013.01); *E04B 2002/0232* (2013.01); *E04B 2002/0289* (2013.01)

(58) Field of Classification Search
USPC ..... 52/293.3, 309.16
See application file for complete search history.

(56) References Cited

U.S. PATENT DOCUMENTS 4,426,818 A * 1/1984 Hoffmann ..... E04B 1/80 52/309.4
4,471,591 A * 9/1984 Jamison ..... E04B 1/10 264/46.4
4,833,855 A 5/1989 Winter, IV
4,981,003 A * 1/1991 McCarthy ..... E04C 2/205 52/309.13
5,067,296 A * 11/1991 Brown ..... E04C 2/386 52/295
5,297,369 A * 3/1994 Dickinson ..... E04B 2/7411 52/145
5,505,031 A * 4/1996 Heydon ..... B26D 3/006 52/241
5,953,883 A * 9/1999 Ojala ..... E04B 1/26 52/220.1
8,561,371 B2 * 10/2013 Sanders ..... E01F 8/0023 52/745.09
8,919,062 B1 * 12/2014 Viness ..... E04F 13/0875 52/220.5
2002/0108333 A1 8/2002 Clayton
2002/0108336 A1 * 8/2002 Maimon ..... E04C 2/296 52/309.9
2006/0096214 A1 * 5/2006 Groschup ..... E04C 2/296 52/415
2007/0294971 A1 12/2007 Blahut
2008/0236081 A1 10/2008 Kennedy
2011/0072753 A1 * 3/2011 MacDonald ..... E02D 29/025 52/562
2014/0123583 A1 5/2014 Arriola Serrano

FOREIGN PATENT DOCUMENTS

| | | | |
|---|---|---|---|
| DE | 1609369 | | 7/1970 |
| EP | 0244312 | B1 | 9/1991 |
| EP | 0744507 | B1 | 7/2001 |
| EP | 2025823 | A1 | 2/2009 |
| EP | 2226444 | A2 | 9/2010 |
| EP | 2505730 | B1 | 10/2013 |
| EP | 2633133 | B1 | 12/2014 |
| FR | 1570606 | | 6/1969 |
| FR | 2972742 | A1 | 9/2012 |
| GB | 897995 | A | 6/1962 |
| GB | 1054088 | | 1/1967 |
| GB | 1177582 | | 1/1970 |
| GB | 2088925 | A | 6/1982 |
| GB | 2135708 | A | 9/1984 |
| IE | S67536 | B2 | 4/1996 |
| PL | 266188 | A1 | 12/1988 |
| PL | 266189 | A1 | 12/1988 |

* cited by examiner

BUILDING BLOCK FOR WALL CONSTRUCTION

The present invention is related to a building block for wall construction, according to the preamble of claim 1.

Especially, the present invention is related to building blocks having a self-supporting construction.

BACKGROUND

At building of houses, habitats, industrial buildings and other buildings it is an increasing focus on that the building process itself should be as effective as possible and that the costs should be as low as possible.

At building of houses presently is used, among others, complete sections where doors and windows, as well as furnishing can be arranged. This makes them heavy, something which is resulting in that cranes are need for assembling them. As they are custom-adapted to the individual building individual adaptions at the assembly site is not possible.

Some solutions which have been used more and more lately are so-called "sandwich elements", which usually are arranged for being fixed to a framework of e.g. metal or wood. Sandwich elements are usually formed by an insulating material in the center with cover materials on both sides.

There also exist some solutions of the type sandwich elements which are not designed for being fixed to a framework, but which forms a wall by being fixed to other sandwich elements, typically after the Lego principle.

EP0744507 A1 discloses such a sandwich element where it in the insulation forming the core of the wall element exhibits projections on the side facing up and recesses at the side facing down, which projections and recesses are adapted to one another, so that when two elements are arranged over one another the projections and recesses form a connection.

A similar solution is also known from WO12056394, but where there are two projections at the side facing up and correspondingly, two recesses at the side facing down.

US 2006/096214 A1 describes a building system for erection of buildings, including walls being configured from panel-like elements, where the mentioned panel-like elements are produced from a material containing vegetable fiber material, especially wood chippings, and have recesses for receiving columns for a supporting construction.

From US 2008/0236081 A1 it is known an insulated building block which has a three-section configuration where a first cementitious segment contains the internal core hole of the block which locks with a second segment of serpentine configured insulated insert. The insulation insert is operatively arranged to have multiple lips that mate with various indented ledges on each of the other segments in a location proximate to the surface of the cementitious segments. The insulating insert is also configured with wedge holes that accommodate wedges which press into the installation to maintain continuity of the block. The insulation insert has groves that in combination with the other segments form a trough in fluid communication with drainage holes which extend through the insulation insert which allows for condensation and seepage of water to drain from the block.

US 2002/0108336 A1 describes a modular wall segment for constructing a wall including two external layers of selected size and shape bonded to the opposite faces of a plurality of contiguously placed cellularized cement blocks.

The segments may be formed with end faces defining slots of various configurations for receiving various types of fastening elements to enable a plurality of such segments to be secured together in a modularized fashion. Other examples of corresponding solutions are EP0244312, EP2025823, EP2226444, EP2505730, U.S. Pat. No. 4,833,855A, US2014123583, IE S67536 B2, GB 897995 A, BE 1016469 A6, US 2002/0108333 A1 and GB 2135708 A. E.g. some of these solutions are casted blocks, i.e. EPS blocks, which are casted blocks containing insulation and exhibit a shape and size as an enlarged Lego block.

There are several disadvantages with these solutions. The first disadvantage is that the element itself is self-supporting for the element, but is not arranged for forming a load-bearing structure for floors, ceiling and further floors. The second disadvantage is that the cover materials are arranged to the insulating layer which contributes to forming the load-bearing construction, while the insulation in such a way only is contributing in the form of accommodating possible pressure forces in vertical direction. A third disadvantage is that these elements are not capable of handling torsional forces which can arise. Another disadvantage is that they need to have a relatively large thickness for exhibiting sufficient strength. Further, several of these elements of prior art have a challenge with thermal bridges.

A further disadvantage is that they during the assembling do not provide solutions which in an easy way can be moved or attached and detached.

In other words, the prior art solutions are best suitable for non-loadbearing walls as they will not posses a load-bearing structure which corresponds to the requirements for load-bearing structures today.

The main object of the present invention is to provide a building block for wall construction, which partly or entirely solves the above-mentioned disadvantages of prior art.

It is further an object of the present invention to provide a building block having the strength and rigidity for forming a wall construction capable of supporting floors and ceilings/roofs.

It is further an object of the present invention to provide a building block having strength against torsion.

An object of the present invention is to provide a building block where insulation is a part of the load-bearing structure of the building block.

It is further an object of the present invention to provide a building block which has a load-bearing structure formed by load-bearing walls (laths), insulation and reinforcing elements.

A further object of the present invention is that the building block should have as low weight as possible and at the same time have desired strength.

Further objects of the present invention will appear from the following description, drawings and claims.

SUMMARY

A building block for forming a wall construction which solves the above-mentioned objects is described in claim 1. Preferable features of the building block are described in the remaining claims.

The present invention is based on building blocks formed by an inner structure/core which is formed by vertical load-bearing walls (laths) and insulating material provided with recesses for receiving the load-bearing walls (laths). These vertical load-bearing walls can also be referred to as laths which are considerably thinner than traditional studding. The inner structure is further formed by at least one longitudinal reinforcing element arranged in recesses in the insulating material and the vertical walls (laths). The vertical load-bearing walls, insulating material and the at least one reinforcing element binding the vertical load-bearing walls (laths) together form together the basic load-bearing in the building block, and where outer cores of the building blocks, i.e. areas of the building block outside the reinforcing element(s) having insulating material and vertical walls (laths), have supplementary and reinforcing properties. The building block has (typically) one inner core and at least one outer core. An outer core will be for special building blocks, while a regular building block will have two outer cores, one on each side of the inner core.

Further, the insulating material preferably is of a type which has high compressive strength/stand high load in vertical and horizontal direction.

In the inner core of the building block it is the vertical walls (laths) which have the load-bearing function horizontally and the load-bearing walls (laths) are held in position by the insulating material in the inner core and bound together by the reinforcing element(s), and that the insulating material together with the load-bearing walls (laths) and reinforcing element(s) (which contributes to bearing a part of the horizontal load) for itself as a single block, and at the same time a fundament for building blocks which are arranged thereon.

The insulating material together with the vertical walls (laths) and reinforcing element(s) form load-bearing construction vertically, at the same time as they together with the outer core(s) form load-bearing construction for torsional forces in the building block alone, or as a group, assembled as a wall construction.

The outer parts (outer cores) of the building block with outer part(s) of the vertical walls (laths) and outer part(s) of the insulating material form together or individually at each side of the inner core stabilization for the inner core where the torsional effect and the vertical forces are further reinforced, for the inner core of the building block.

The horizontal load-bearing of the building block is provided by the inner core where the load-bearing walls preferably overlap each other from both sides, and where the inner parts of the insulating material and the load-bearing walls with one or more reinforcing elements in recesses in the insulating material and the vertical walls (laths) binding the load-bearing walls (laths) together so that they are positioned in a fixed and stable position together with the reinforcing elements.

The vertical walls (laths) of the building blocks are arranged in a pattern of load-bearing walls (thin laths) which preferably is dividable in two. In this way each building block could constitutes a series of building blocks which can be turned so that both longitudinal sides of the building block can be used as inner or outer part of a wall.

The load-bearing walls (laths) can be arranged after different patterns or shapes, where the load-bearing horizontal forces are determining for the assembly, and where the reinforcing element(s) is/are adapted to the inner core and this is positioned against the outer core(s) where the assembly does not provide worse results than a solution with load-bearing walls (laths) arranged in the middle of the building block with similar outer cores.

A regular building block will thus have four, eight, sixteen, etc. vertical walls (laths) so that the building block can be divided, and the structure in the load-bearing walls (laths) is maintained together with the stabilizing material which is the insulating material and the reinforcing element(s).

In this way load-bearing walls (laths) can be arranged in the insulating material which, either extend in a plane perpendicular to the longitudinal direction of the building block, or which extend with a given angle inclined in relation to the longitudinal direction of the building block, and thus form a desired pattern.

The vertical load-bearing walls (laths) for all embodiments according to the present invention have an extension in width direction of the building block which is shorter than the width of the building block, so that there is no contact between the side walls (longitudinal sides) of the building block to avoid forming thermal bridges (cold bridges). The vertical walls (laths) will usually be arranged at both sides of the building block, but for adaption blocks they can be arranged at only one side of the building block. As mentioned above, the load-bearing walls (laths) do not extend the entire width of the building block and correspondingly the recesses in the insulating material do not extend the entire width of the insulating material. This is an important feature to avoid thermal bridges as it then always will be insulation between the load-bearing walls and the opposite side wall (longitudinal side) of the building block and it is thus formed a passage free of thermal bridges/heat leakage passage in the building block.

The reinforcing element(s) at the same time form a binding between the outer core(s) of the building block such that the wall construction will not collapse in a fire.

The reinforcing element(s) alone will provide balancing of pressure loads between load-bearing walls (laths) in the inner core of the building block if displacement of building blocks should arise and the load-bearing walls (laths) are not aligned to each other by assembling in height.

The reinforcing element(s) and recess(es) for reinforcing elements can also be integrated as top sills, groundsills and support beams over windows and door areas.

In connection with the recesses for the reinforcing element(s) in the insulating material there are further preferably arranged drainage channel(s), as the reinforcing element(s) form top/bottom barriers for condensation and condensation water, so that moisture do not leak out into the construction, but leave via drainage hole(s) arranged in connection with the drainage channel(s).

The drainage channel(s) preferably has/have a drainage hole to each side of the building block, such that the building block can be turned, so that one branch of the drainage hole is for in air and the other for runoff at the part facing out. Opposite it will work as in air and out air.

The drainage channel can further be integrated in top sills, groundsills and support beams (together with reinforcing elements and recesses for reinforcing elements), including drainage holes and side pieces on the sill/beam are preferably provided with balancing pieces of insulating material as a general sill/beam.

In addition to the above, the reinforcing element will act as guiding tracks for building blocks to be arranged to another building block.

The building block will further be provided with recesses for reinforcing elements both at upper side and lower side. The recesses are adapted to the height of the reinforcing elements, so that when two building blocks are arranged on top of each other the recess on upper side of the lowest building block and the recess of the lower side of the uppermost building block will fit accurately to the height of the reinforcing element, i.e. the recesses have a depth corresponding to half of the total height of the reinforcing elements.

The reinforcing element(s) can further be provided with fastening points for side plates or cover plates, e.g. in the form of a click-system, and the reinforcing element(s) will then form the load-bearing element for fastening of the side plates or cover plates. In such a case the side plates or cover plates are provided with fastening devices with a click-system which are arranged for extending through through holes or a tube in the insulating material and in to the reinforcing element for engagement with this. In this way a secure fastening of the side plates or cover plates is achieved when they are pushed partly or entirely in against the building block. The fastening devices on the side plates or cover plates are preferably arranged in a pattern which results in that the side plates or cover plates can overlap building blocks of different sizes.

The side plates or cover plates can alternatively be fastened to the building blocks by means of gluing to the load-bearing walls and insulating material or by bolting to the load-bearing walls.

An important feature of the present invention is that the side plates or cover plates are not responsible for carrying any of the load or pressure; as opposed to prior art where the side plates or outer cover of the blocks have the main responsibility for carrying the load or pressure.

The reinforcing element(s) are further preferably manufactured with an exterior surface of a non-conductive material to reduce the thermal bridge, while the inner core can consist of different conductive materials, where glue is not used for fastening of the reinforcing elements.

The reinforcing element(s) can further be duplex and provide a click-system for fastening of the reinforcing elements to the recesses in the insulating material and/or the load bearing walls (laths) for arrangement and locking of the reinforcing element with fastening horizontally or vertically, dependent on which locking one desires. The click-system can e.g. be formed by that a female part is arranged and fixed in the recess in the insulating material and the load-bearing walls at one side of the building block and a male part which fits into the female part for secure engagement therein is arranged in a recess at the corresponding side of another building block which is to be attached thereto. The reinforcing element(s) will thus act as a locking for preventing expanding glue from displacing the separate blocks from position at assembly.

With an overlap of side plates or cover plates over different building blocks this also forms a constructional improvement by that the horizontal reinforcements are improved by the locking itself into the reinforcing element and that the side plates or cover plates can be a part of the load-bearing construction for vertical and horizontal forces.

For the building block to exhibit highest possible strength the load-bearing walls (laths) are not randomly arranged and the load-bearing walls (laths) are preferably arranged such that they are not positioned directly opposed to each other, but they are displaced in relation to each other in the longitudinal direction of the building block, so that they alternating extend towards the other side of the building block. The load-bearing walls (laths) can further exhibit different length on one side of the building block in relation to the other side of the building block. By that one can use different lengths of the load-bearing walls (laths) at the two sides of the building block, this results in that one can move the thermal bridge (condensation point) defined by the positioning of the reinforcing element towards the inner wall or towards the outer wall dependent of desired specifications for the building block. In warm regions it will often be a requirement that the building block should keep heat out and by that the load-bearing walls (laths) then have a longer extension at the outer side wall than the inner side wall, one can move the reinforcing element and therethrough the thermal bridge (condensation point) in towards the inner side wall. In the opposite case it will in colder regions often be a requirement that one should keep the cold out, something which can be achieved by that the load-bearing walls (laths) at the side towards the inner side wall exhibit a longer length than the load-bearing walls (laths) at the side towards the outer side wall, so that the reinforcing element and therethrough the thermal bridge (condensation point) is moved towards the outer side wall.

In other words, the load-bearing walls (laths) form groups of load-bearing walls (laths) in a desired pattern bound together by the reinforcing elements, either between load-bearing walls (laths) at same side of the building block, or between load-bearing walls (laths) from both sides of the building block.

In addition the load-bearing walls (laths) may, as mentioned above, have different lengths, so that there are formed several rows of groups in addition to the above mentioned by adjusting the thermal bridge inwards or outwards in the building block.

Building blocks based on the principles according to the present invention can have any width, length and thickness. In addition one can, when needed, arrange additional longitudinal reinforcing elements.

The building block can preferably have different shapes for different properties, such as bottom block, general building block, top block, closing block, and possibly specially adapted blocks for partitions between floors.

The bottom block will correspond to the above described building blocks, but will in addition be provided with a larger centrally arranged longitudinal recess at the underside adapted for accommodating a groundsill which is used for attaching the building block to a foundation wall or concrete surface.

The top block will also correspond to the above described building blocks, but will in addition be provided with a larger centrally arranged longitudinal recess at the upper side for accommodating support beams, which top blocks will be used on both sides of doors or windows such that support beams can be arranged over and under the windows or doors. In this way the construction will be solid and the pressure load is balanced over doors and windows. When the top block is arranged over all doors and windows general blocks can be arranged therebetween.

Further, the building blocks can be shaped as adaption blocks, which will be useful in connection with arrangement of wall constructions between existing constructions. At alignment against existing top sills one will not when one reach the top have place for a general building block. Adaption blocks being divided in two, either provided with a recess adapted the top sill or by that that the width is adapted so that the top sill can be arranged in between, so that these adaption blocks can be arranged from both sides of a wall construction being erected and fastened to the top sill to make the wall construction complete.

It should here be noted that recesses for reinforcing elements and reinforcing elements, and drainage channel, are arranged interior of the longitudinal central recesses.

Special building blocks for partitions between floors will be a combination of the top and bottom block, by that it exhibits a centrally longitudinal recess both at the upper side and underside of the building block for accommodating top sills for final wall construction and ground sill for the next floor.

It should be noted that in connection with building blocks being adapted for sills or beams, the reinforcing elements and recesses for the reinforcing elements, and drainage channel are integrated as a part of the sill or beam, and so that these are arranged to the building block by means of the above mentioned click-system.

Incidentally it should be noted that bottom blocks are arranged to each other and to the groundsill by means of the above mentioned click-system, and preferably in addition gently expanding glue. Correspondingly, when building blocks are to be arranged on top of other building blocks both the click-system and gently expanding glue are used.

For top blocks correspondingly apply that the support beams are arranged to the building blocks by means of the above mentioned click-system and that gently expanding glue is used.

For special building blocks for partitions between floors apply the same as for the bottom block, but in addition the groundsill for the next floor is arranged to the upper side of the building block by means of the above mentioned click-system.

If one does not use reinforcing elements with the above mentioned click-system, i.e. reinforcing elements being glued to the recesses for the reinforcing elements, one can use screws extending through the building block and into the load-bearing walls of building blocks under or sills under, and use of gently expanding glue.

The building blocks are preferably made of materials being easily adaptable at the site by cutting them to desired length, Further, the building blocks according to the present invention can extend in two planes which join to form a corner with desired angle. Even more alternatively one can imagine building blocks extending in more than two planes for forming further variants.

An alternative solution to this which can also be used is that one in connection with corners cut the adjacent building blocks which are to form a corner in a 45 degree angle for forming a 90 degree corner. Of course one can cut the building blocks so that a desired angle for a corner exhibits different angles than this general alternative.

The building blocks according to the present invention can be manufactured in different thicknesses and with different strength dependent on requirements for load-bearing capacity and insulation. The dimensions of the load-bearing walls (laths) can be adapted after need, but in principal the dimensions of the load-bearing walls (laths) increase with the dimension of the building block.

In cases where the reinforcing elements do not exhibit the above mentioned click-system, the present invention can further include fastening means arranged for detachable fastening of building blocks together. This can e.g. be provided by a specially adapted lock element which by movement one way locks the building blocks to each other, either in horizontal direction or in vertical direction, or in both directions, while movement in the opposite direction releases the locking of the building blocks to each other and therethrough provide a corresponding click-system which used for the reinforcing elements. This can e.g. be achieved by a specially adapted locking element and recesses arranged in upper and lower or side walls of the building block, or end walls thereof, preferably in connection with the locking elements.

Further, preferable features and advantageous details of the present invention will appear from the following example description.

BRIEF DESCRIPTION OF THE DRAWINGS

In the following the present invention will be described in further detail with references to the attached drawings, where.

DETAILED DESCRIPTION

Figure 1A:
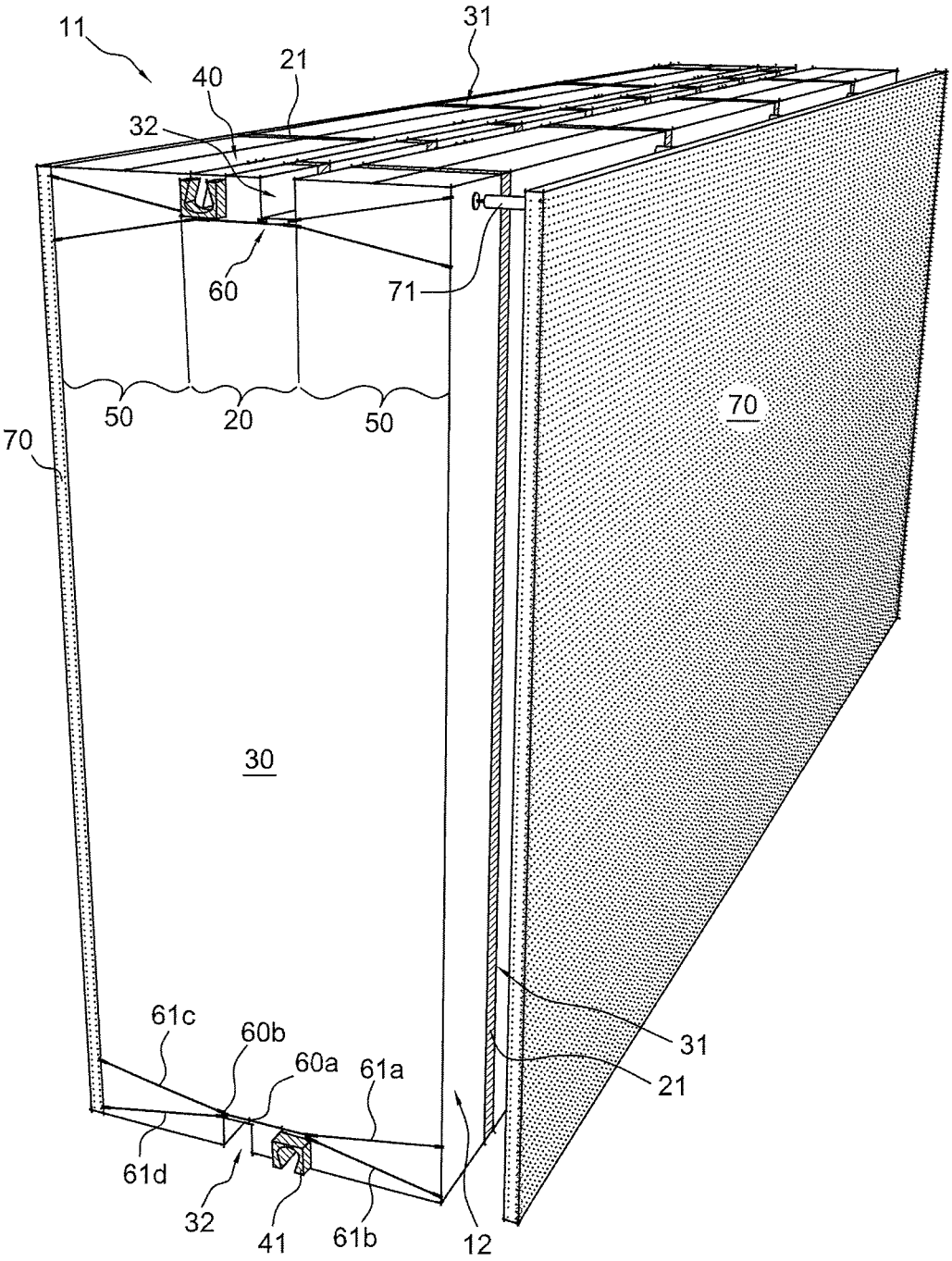
FIG. 1*a* is a principle drawing of a building block according to a first embodiment of the present invention.
Figure 1B:
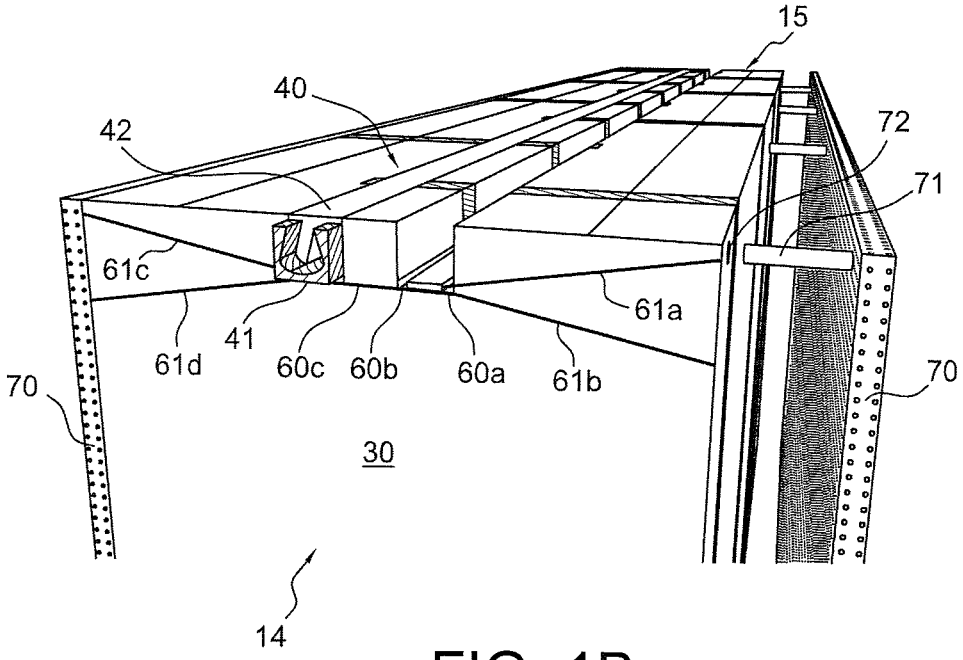
FIG. 1*b* shows further details of the first embodiment.
Figure 1C:
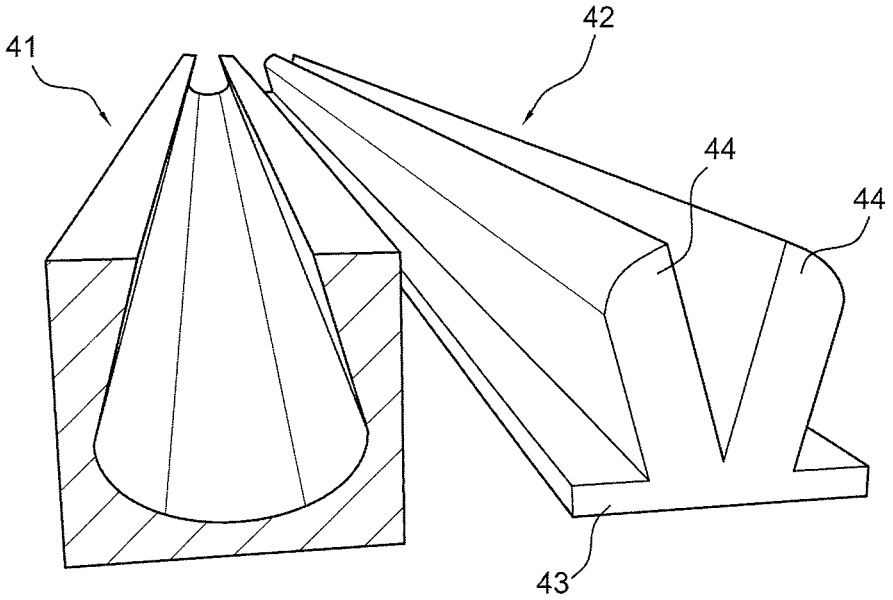
FIG. 1*c* shows details of reinforcing elements forming a click-system.
Figure 1D:
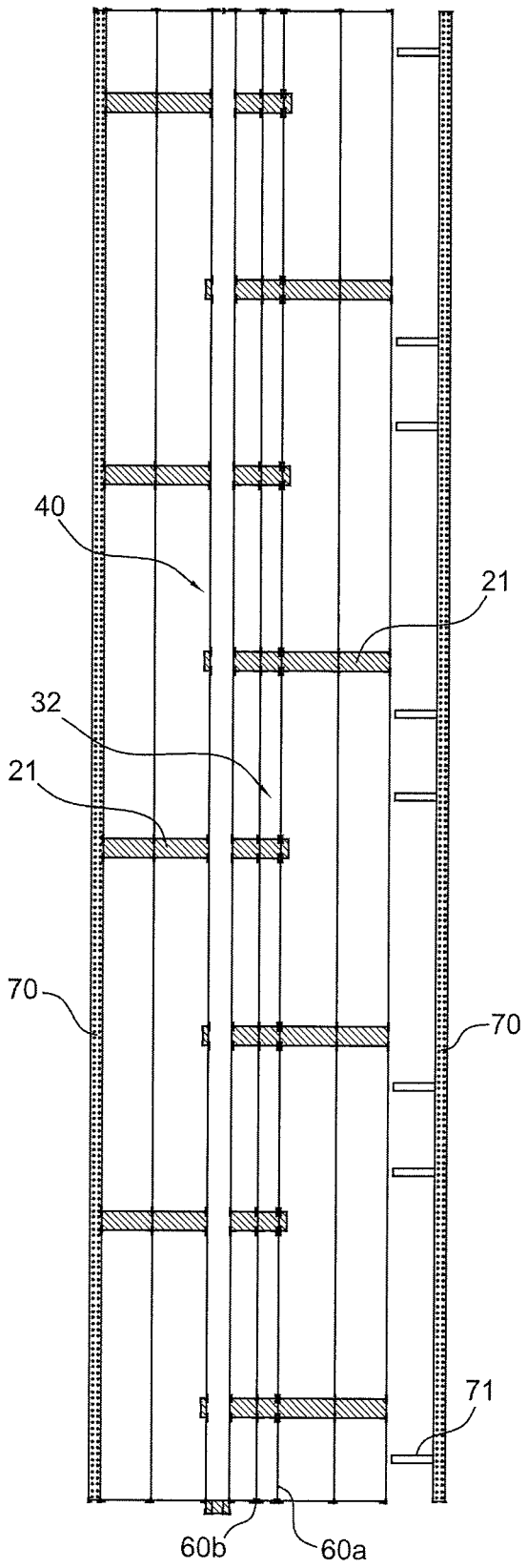
FIG. 1*d* shows the building block in FIG. 1, seen from above.

Reference is now made to FIG. 1*a* which is a principle drawing of a building block 11 according to a first embodiment of the present invention illustrating the principles of the present invention, FIG. 1*b* showing details of the first embodiment and FIG. 1*d* showing a view from above. The building block 11 is formed by an inner structure or core 20 which is formed by vertical load-bearing walls 21 in the form of thin laths, insulating material 30 of a type with high compressive strength/sustains high load in vertical and horizontal direction provided with recesses 31 for accommodating the load-bearing walls 21, which typically are glued with a gently expanding glue or casted into the insulating material 30 and therethrough securely fixed thereto, and at the same time ensures that it is completely sealed around the insulating material 30 and the load-bearing walls 21. Examples of suitable materials for the insulating material 30 is XPS (extruded polystyrene), EPS (expanded polystyrene) or similar, also known as Styropool or Styrofoam.

The inner structure or core 20 is further formed by at least one longitudinal reinforcing element 40 adapted for being arranged in recesses 32 extending down in both the insulating material 30 and the load-bearing walls 21. In the shown example, the use of two reinforcing elements 40 and two recesses 32 is shown. The recesses 32 and reinforcing elements 40 are adapted to each other such that when two building blocks 11 are arranged on top of each other, the recesses 32 correspond to the height of the reinforcing element 40. As shown in FIG. 1*a*, the building block 11 will be provided with recesses 32 in the insulating material 30 and load-bearing walls 21 at both upper and lower side of the building block 11. In the inner structure it is the load-bearing walls 21 (laths) which provide the load-bearing function horizontally, while the insulating material 30 holds the load-bearing walls (laths) 21 in position and the longitudinal reinforcing elements 40 are binding the load-bearing walls 21 together, and that the longitudinal reinforcing elements 40 will contribute to a part of the horizontal load-bearing. In this way, the building block 11, by the insulating material 30 together with the load-bearing walls 21 and the longitudinal reinforcing elements 40 is self-supporting; both as individual block and at the same time as fundament for building blocks being arranged thereon, which will be further described below.

In the example the load-bearing walls 21 extend mainly perpendicularly out from the respective longitudinal side 12, 13 of the building block 11, in a direction towards the opposite longitudinal side 12, 13. The load-bearing walls 21 have an extension in vertical direction which corresponds to the height of the building block 11 and have an extension in width-direction of the building block 11 being shorter than the distance between the longitudinal sides 12, 13 of the building block 11 for avoiding formation of thermal bridges, so that there always is insulating material 30 between the longitudinal sides 12, 13 of the building block 11. The number of load-bearing walls 21 and dimension of the load-bearing walls 21 are adapted to the desired properties/strength for the building block 11.

Further, the building block 11 is formed by at least one outer structure or core 50, in the example two outer cores 50, one on each side of the inner core 20. The outer structure or core 50 is formed by the parts of the load-bearing walls 21 and insulating material being outside the reinforcing elements 40. In this way the outer part of the load-bearing walls 21 (laths) and insulating material 30 form together or individually, at each side of the inner core 20, stabilization for the inner core 20 where the torsional effect and vertical forces are further reinforced, for the inner core 20 of the building block 11.

The horizontal load-bearing of the building block 11 is provided by the inner core 20 which overlap each other from both sides by that the load-bearing walls 21 overlap each other in width-direction of the building block 11, where the inner parts with the reinforcing elements 40 in recesses 32 in the insulating material 30 and the vertical walls 21 (laths) binding the load-bearing walls 21 (laths) together such that they are positioned in a fixed and stable position together with the reinforcing elements 40.

The load-bearing walls 21 (laths) can be arranged in different patterns or designs, where the load-bearing horizontal forces are determining for the assembly, and where the reinforcing elements 40 are adapted to the inner core 20 and where the assembly does not provide a worse result than a solution with load-bearing walls 21 (laths) arranged in the middle of the building block 11 with similar outer cores 50.

Figure 2A:
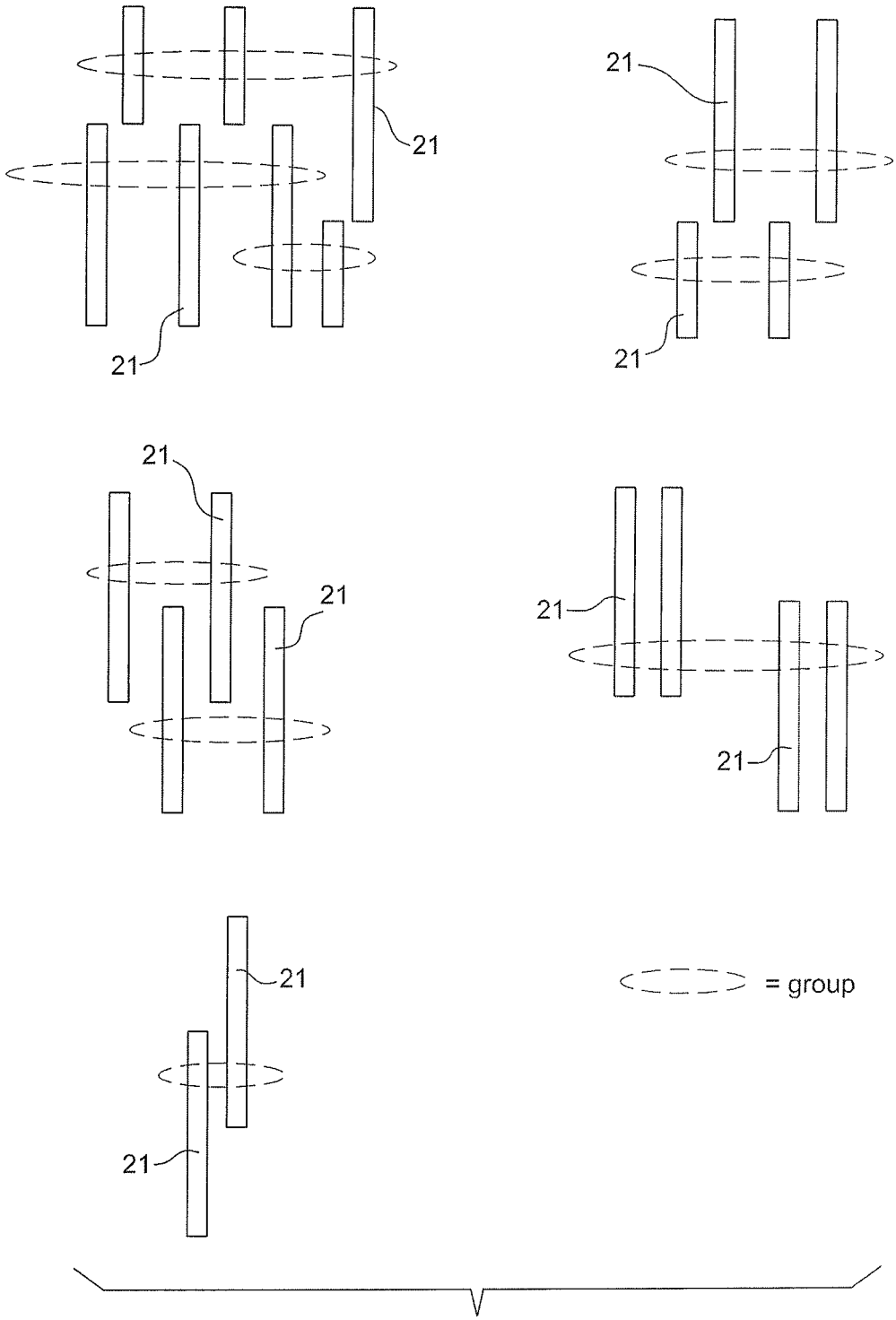
FIG. 2*a-c* are principle drawings of formation of groups of load-bearing walls in the building blocks.
Figure 2B:
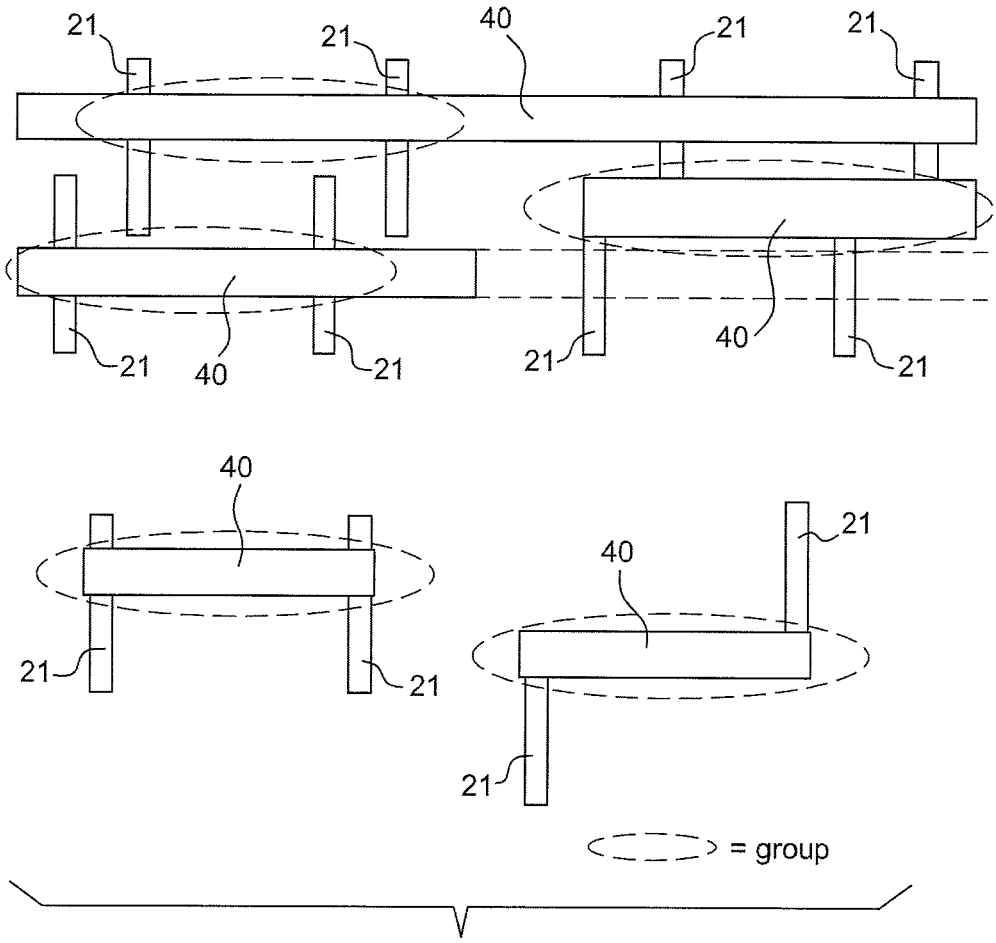
Figure 2C:
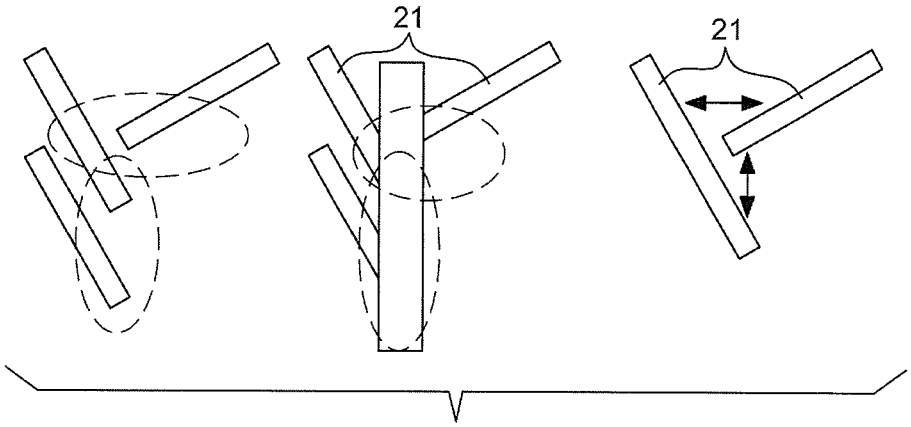

Reference is now made to FIGS. 2*a-c* showing principle drawings disclosing further details of the present invention. The load-bearing walls 21 arranged in the insulating material 30 are arranged so that they form groups of at least two load-bearing walls 21, either at one side of the building block 11 or at both sides of the building block 11 which increase the strength of the building block 11. FIG. 2*a* shows five different examples of what can be considered as a group (denoted with a dotted ring) even though it can be construed innumerable examples of this. In FIG. 2*b* there are shown examples of how the reinforcing elements 40 are contributing in forming the groups. The longitudinal reinforcing elements 40 can extend over a group formed by two or more load-bearing walls 21 at the same side of the building block 11, or extend over groups of load-bearing walls 21 formed from both sides of the building block 11. In this way the reinforcing elements 40 will exchange the pressure/load point between the load-bearing walls 21 forming groups. As shown in FIG. 2*b* the reinforcing elements 40 can extend the entire building block 11, over only one group, or over several groups. The reinforcing element 40 will also contribute to making the building block more torsional stable. In the most cases the building block 11 will have at least one reinforcing element 40 extending the entire length of the building block 11.

In FIG. 2*c* it is shown an example of how groups are formed by inclined load-bearing walls 21, with and without reinforcing elements 40. It should be mentioned that inclined load-bearing walls 21 will at formation of groups provide a larger area for the group than if the load-bearing walls 21 are arranged as in FIGS. 2*a-b*, at the same time as it will make the building block 11 more directionally stable, by that the groups then are capable of accommodating forces in two directions, i.e. horizontally and vertically, as shown in the last drawing in FIG. 2*c*.

How the load-bearing walls 21 are arranged, the pattern of the groups and the use of reinforcing elements 40 will depend on the size of the building block 11 and the requirements for the strength of the building blocks 11.

Figure 3:
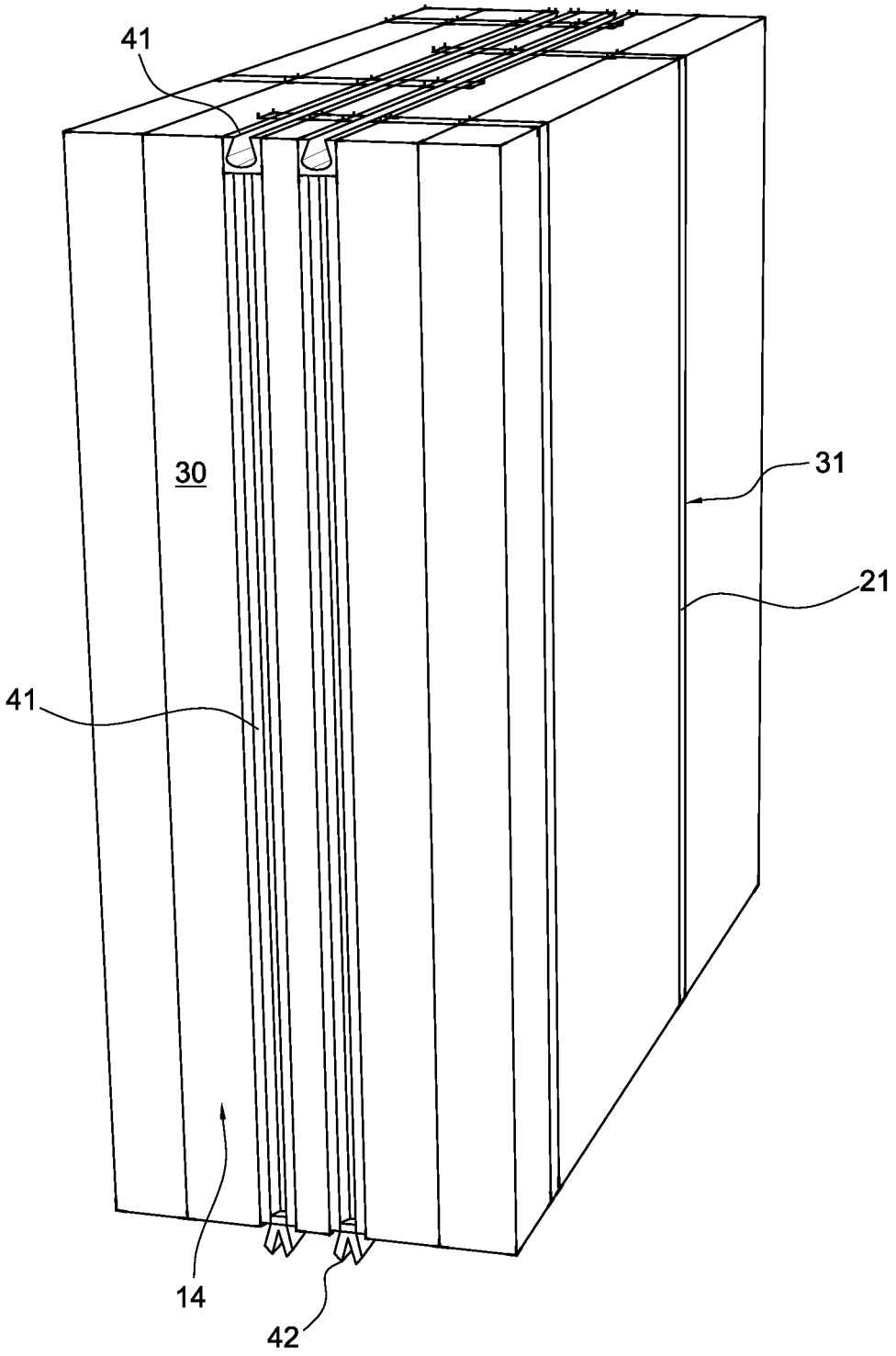
FIG. 3 is a principle drawing of a building block according to a further embodiment of the present invention provided with reinforcing elements at the end sides.

In the embodiment shown in FIGS. 1*a-b* the reinforcing element is duplex in the form of a female part 41 and a male part 42, as shown in detail in FIG. 1*c*. The female part 41 exhibits a mainly U-shape which narrows some in at the opening and is adapted to accommodate the male part 42, which e.g. is shaped with a base 43 where there centrally are arranged two longitudinal upwards from the base 43, and downwards (not shown) from the base 43 (male part 42 in FIG. 1*c* upside-down) protruding flexible elements 44 which can be moved towards each other by applying a force from the side, and which have an inner strength which is resulting in that they will be forced away from each other to return to their initial state. In this way the female part 41 and male part 42 can separately be arranged and fixed in the recesses 32 in the insulating material 30 and the load-bearing walls 21, at opposite sides of building blocks 11 to be arranged to each other. E.g. are all building blocks 11 provided with male parts 42 in recesses 32 at the underside and female parts 41 in recesses 32 at the upper side, as shown in FIG. 3. In this way a building block 11 can be arranged on an underlying building block 11, whereupon a further building block 11 with similar click-system can be arranged thereupon again. In this way it is provided a reinforcing element 40 split in two parts providing a click-system shaped such that it is possible to release the building blocks 11 from each other by pulling them from each other in one direction, while they make it impossible to release the building blocks 11 from each other in another direction. In this way the male part 42 will be securely fixed to a female part 41 of another building block 11 when these are assembled by that the flexible elements 44 are pressed together. Due to the desire of the flexible elements 44 of returning to their initial state, they will lock to the female part 41 in vertical direction. Such a locking mechanism will prevent the building blocks 11 from being separated in vertical direction, but at the same time allows movement in horizontal direction so that a building block 11 can be pulled of an underlying building block 11. In addition to this one can arrange the same solution at the end sides 14, 15 of the building block 11, so that one then will achieve locking in relation to movement in both vertical direction and horizontal direction, and it will then not be possible to disassemble assembled building blocks 11. Such a solution is shown in FIG. 3 which shows how one of the end sides 14 of the building block 11 is provided with recesses 32 in the insulating material 30 for accommodation of the mentioned female part 41 or male part 42 for therethrough to enable fixation in vertical direction to other building blocks 11 which exhibit a male part 42 or female part 41.

Figure 6:
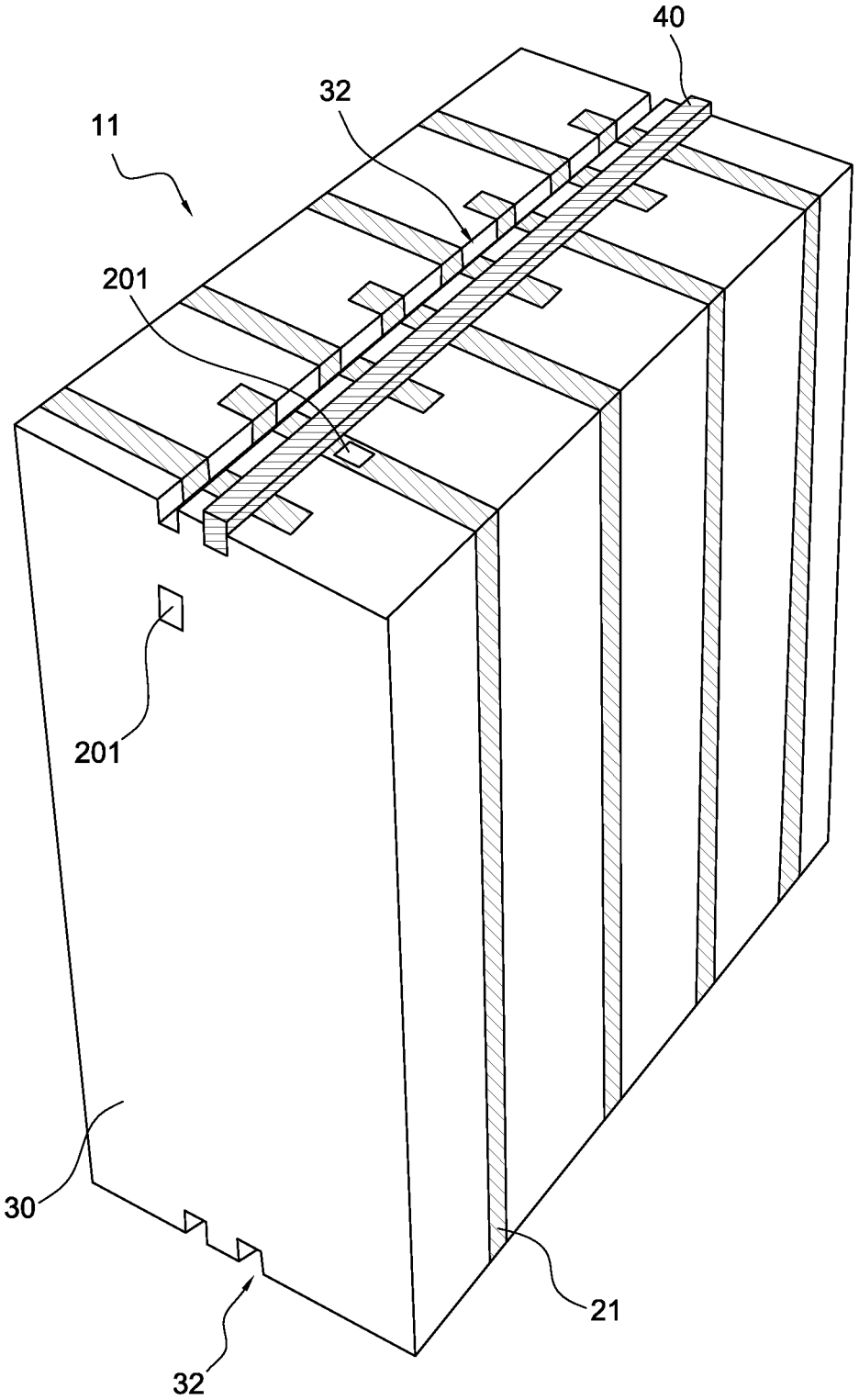
FIG. 6*a*-6*d* show ground sills and top sills with a building block according to another embodiment.
Figure 6A:
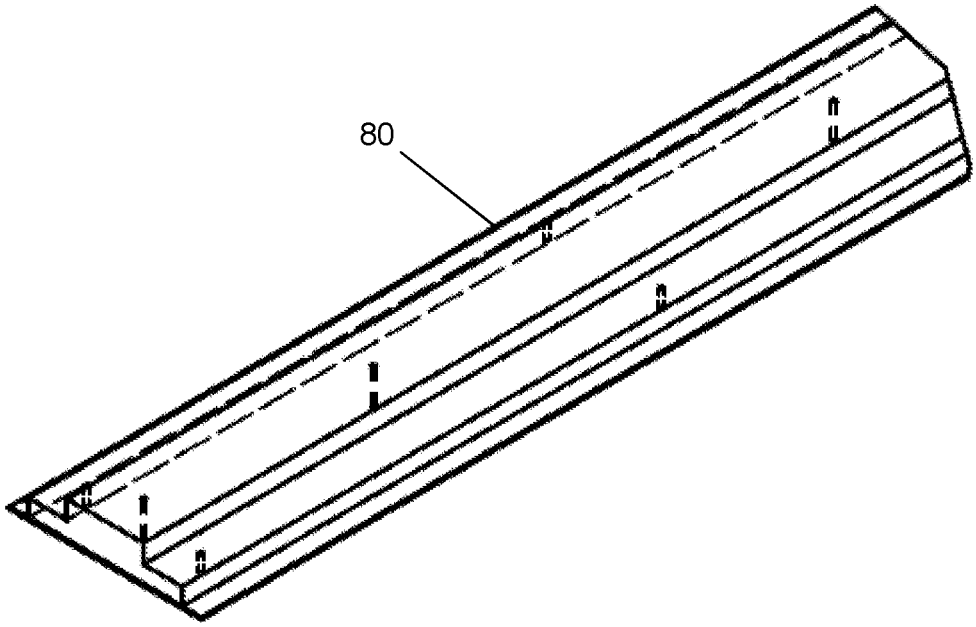
Figure 6B:
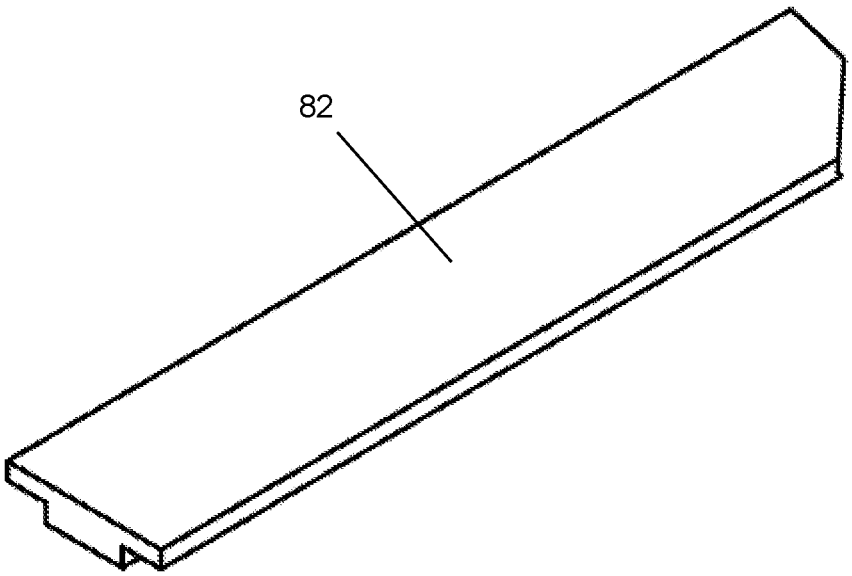
Figure 6C:
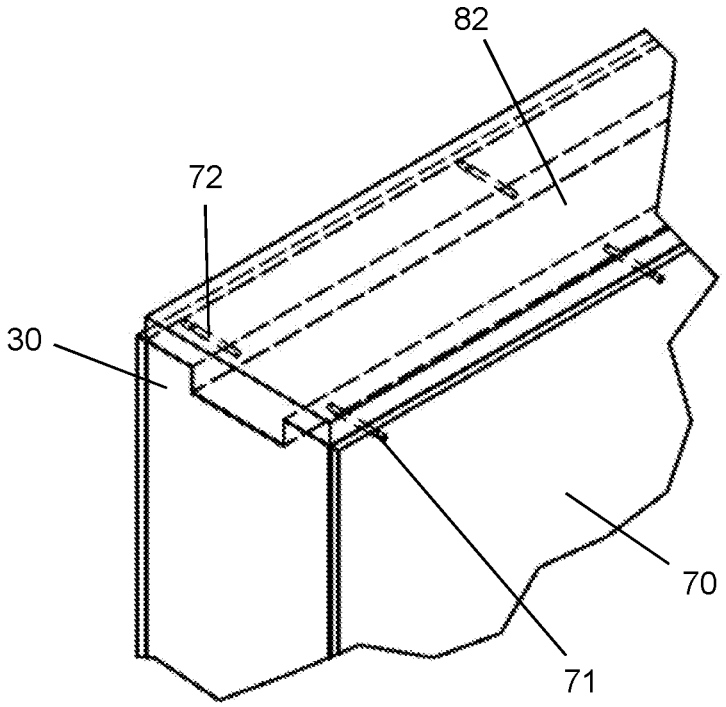
Figure 6D:
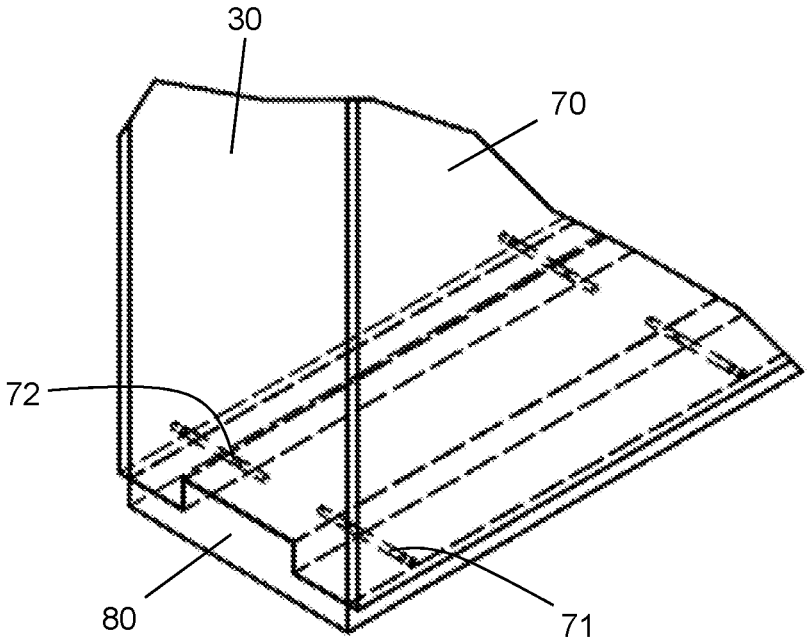
Figure 7A:
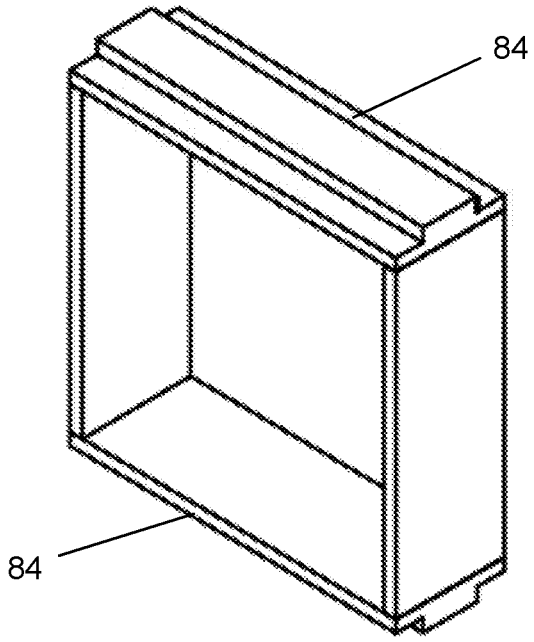
FIG. 7*a*-8*b* show building blocks incorporating windows and doors in another embodiment.
Figure 7B:
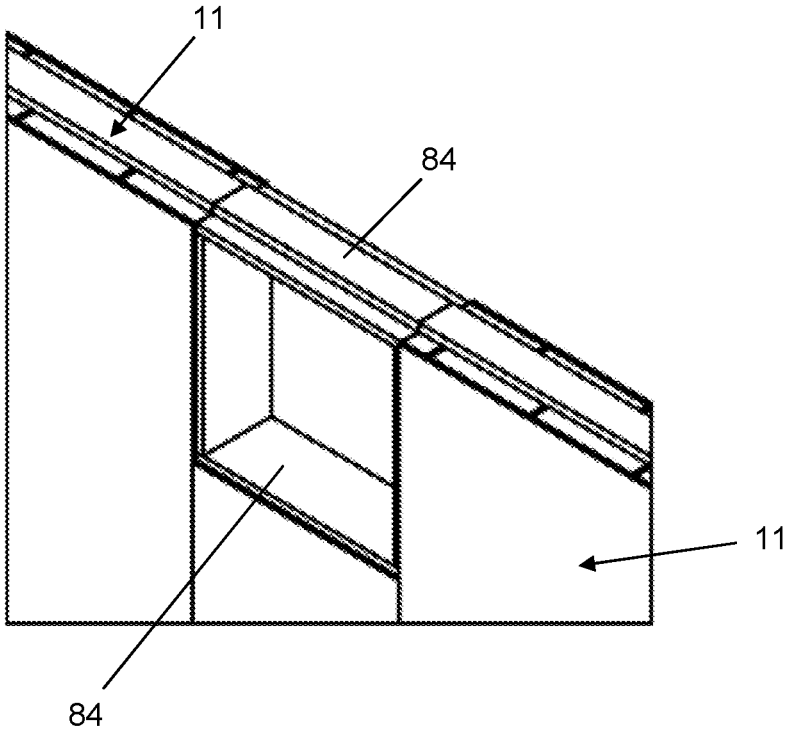
Figure 8A:
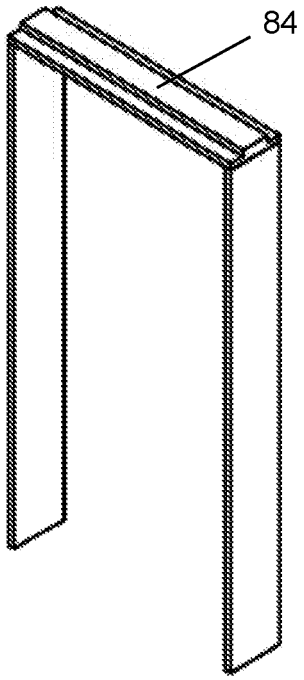
Figure 8B:
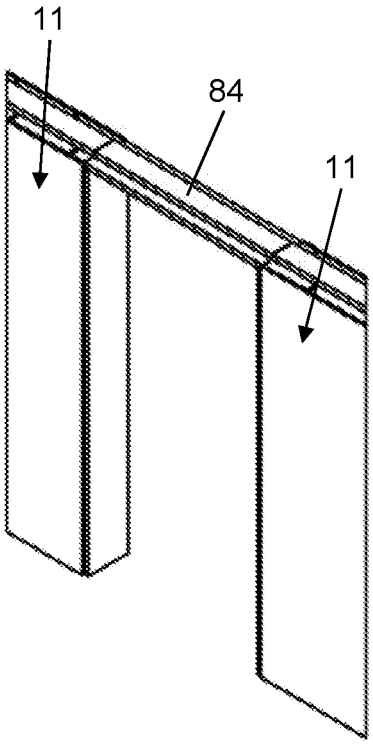

The alternative to the above mentioned use of reinforcing elements 40 in two parts is the use of reinforcing elements 40 exhibiting a mainly rectangular shape, as shown in FIG. 6, and which are glued to the recesses 32 in the insulating material 30 and the load-bearing walls 21, and possibly in recesses 32 at the end sides 14, 15 of the building block 11. The reinforcing element 40 will here e.g. be glued to the upper side of the building block 11, while the underside exhibits recesses 32 for accommodating the reinforcing elements 40, or that the building blocks 11 exhibit recesses 32 at the upper side and that the recesses 32 at the underside are provided with reinforcing elements 40.

Reference is now made to FIG. 1*b* which shows details of the building block 11. In connection with the recesses 32 for the reinforcing elements 40 in the insulating material 30 and the load-bearing walls 21 it is preferably arranged a longitudinal drainage channel 60 in the recesses 32 for the reinforcing elements 40, as the reinforcing elements 40 form top and bottom barriers for condense and condense water, so that moisture does not leak out in the construction. In the shown example there is arranged two longitudinal drainage channels 60*a-b* at each side of the recesses 32. In addition it can be arranged drainage hole or drainage channel 60*c* connecting the drainage channels 60*a-b* of the recesses 32. For guiding moisture out of the construction it is arranged drainage holes 61*a-d* to the drainage channel 60, 60*a-c*. The drainage channels 60, 60*a-c* are preferably arranged to drainage holes 61*a-d* to each side of the building block 11, so that the building block 11 can be turned in all directions, such that one branch of the drainage holes 61*a-b* is for in air and the other side 61*c-d* is runoff/drainage for the part facing outwards. The alternative to the reinforcing elements 40 closing the drainage channels 60, 60*a-b* is that the drainage channels 60, 60*a-b* are formed by pipes.

FIG. 1*b* further shows details of fastening of side plates or cover plates 70 to the building blocks 11. According to the present invention the reinforcing elements 40 are further provided with fastening means (not shown) for forming fastening points for side plates 70 (cover plates), e.g. in the form of a click-system, and the reinforcing elements 40 will then form the load-bearing element for fastening of side plates 70. In such a case the side plates 70 are provided with an insertion screw 71 with a snap-in function at the end entering the reinforcing element 40 through a guiding tube 72 arranged in the insulating material 30. The reinforcing element 40 is provided with a receiving element for snap-in from the side plates 70 and goes in locked position when the side plates 67 are pushed entirely or partly in. The side plates 70 have fasteners insertion screws 71 arranged in a pattern which results in that the side plates 70 can overlap building blocks 11 having similar or different size, as shown in FIGS. 4*a-d*.

The side plates 70 can alternatively be fixed to the building blocks by means of gluing to the load-bearing walls 21 and insulating material 30, or by bolting to the load-bearing walls 21.

Figure 4A:
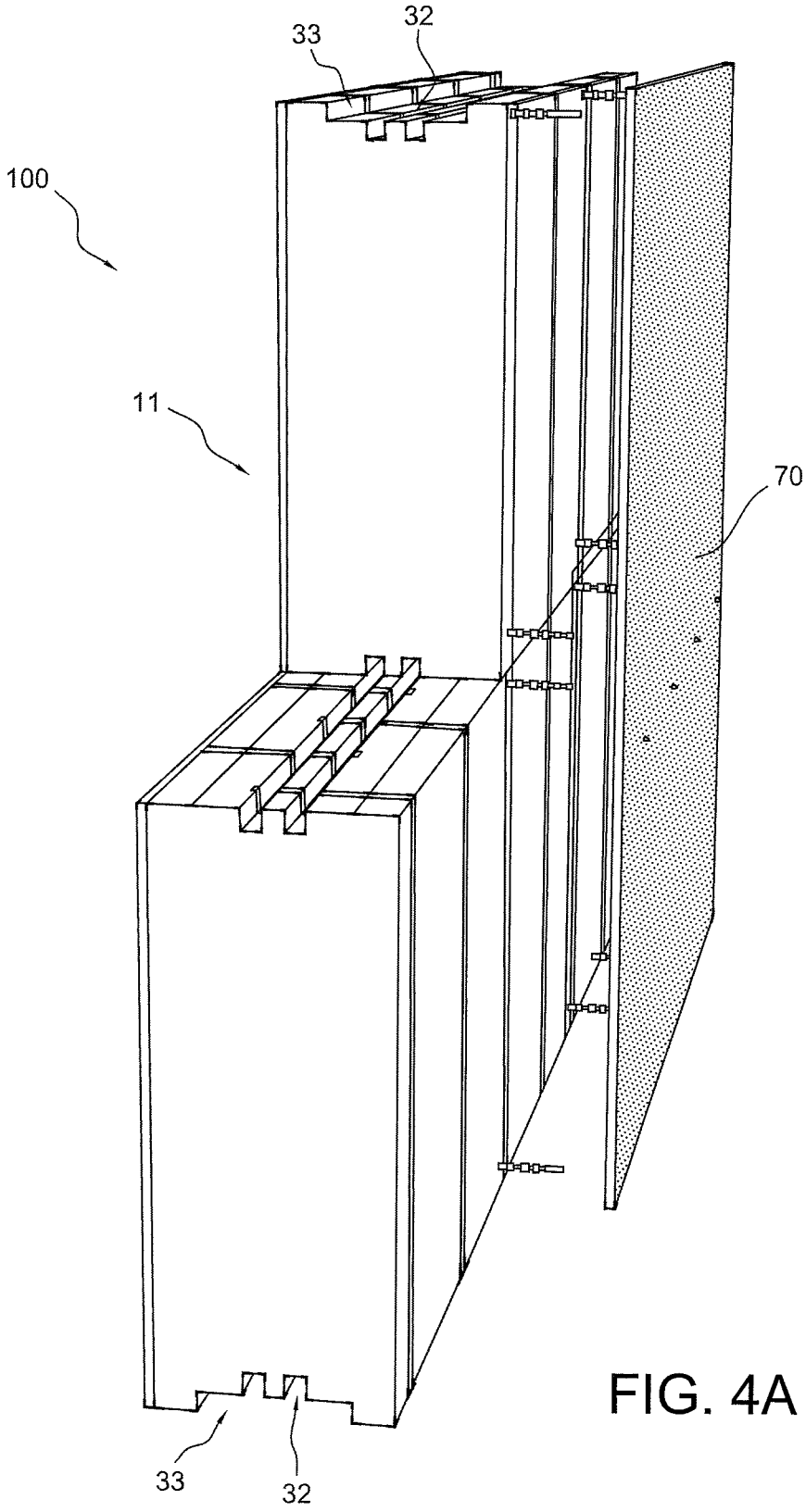
FIG. 4*a-d* show different structures of a wall construction with building blocks according to the present invention with side plates/cover plates of different sizes.
Figure 4B:
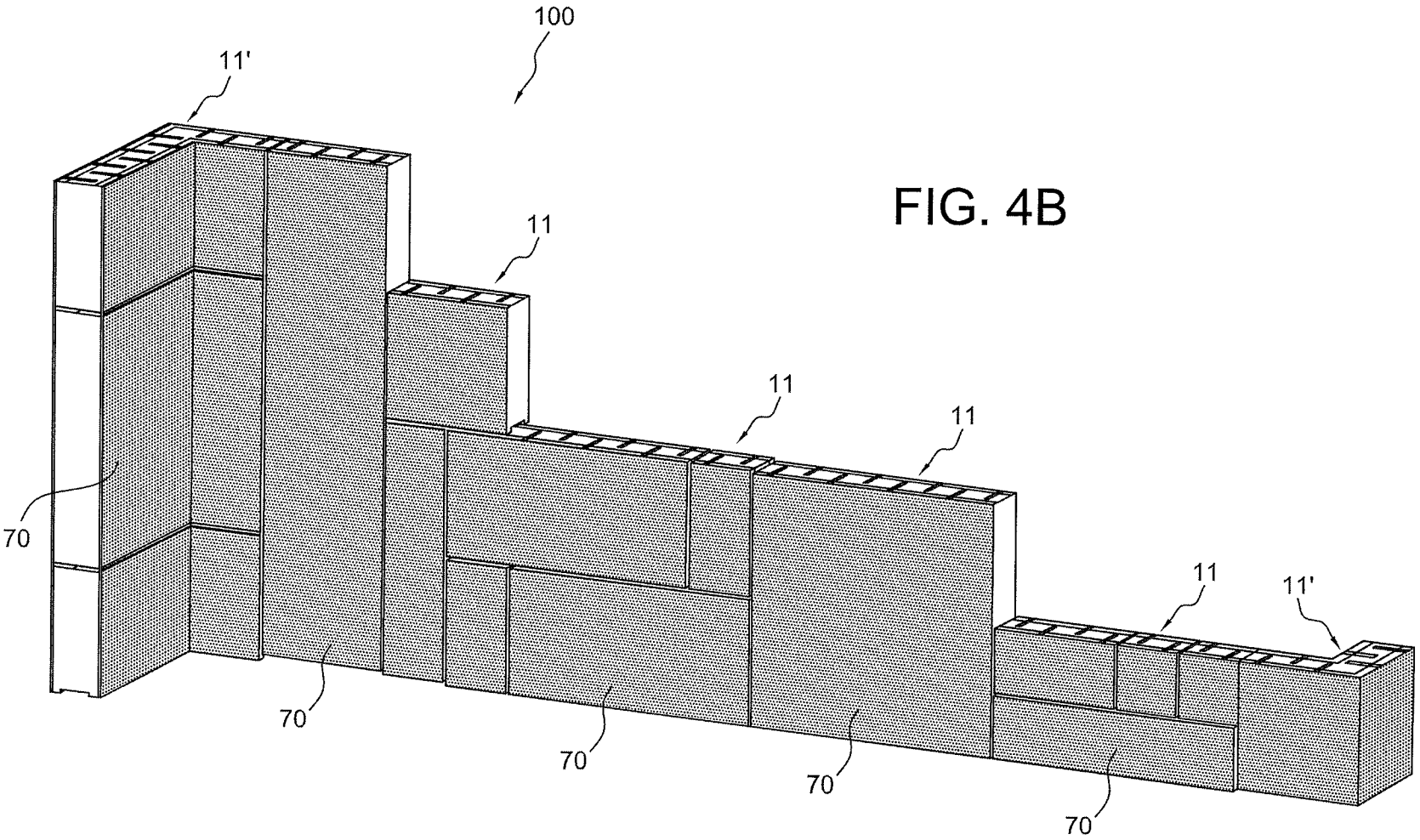
Figure 4C:
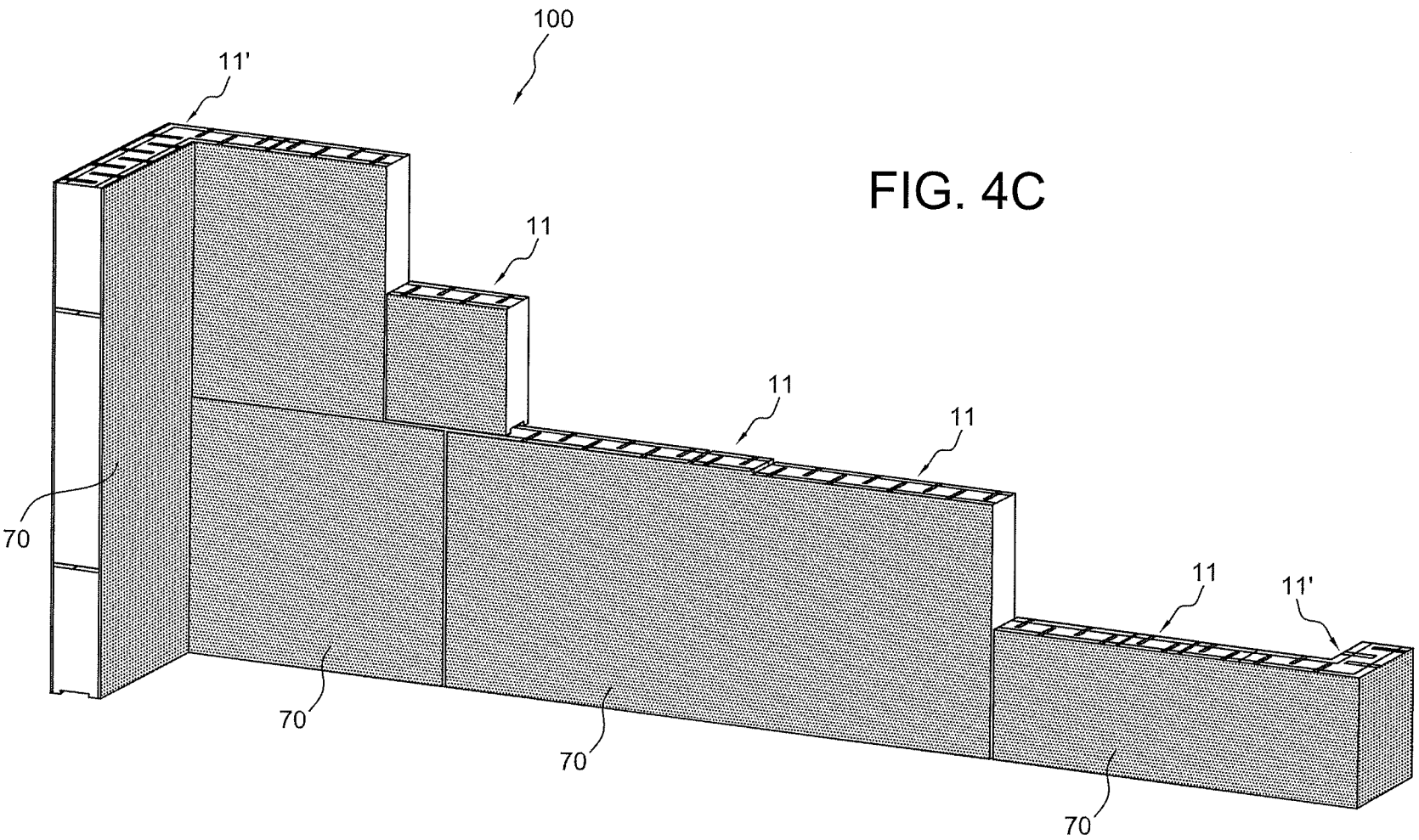
Figure 4D:
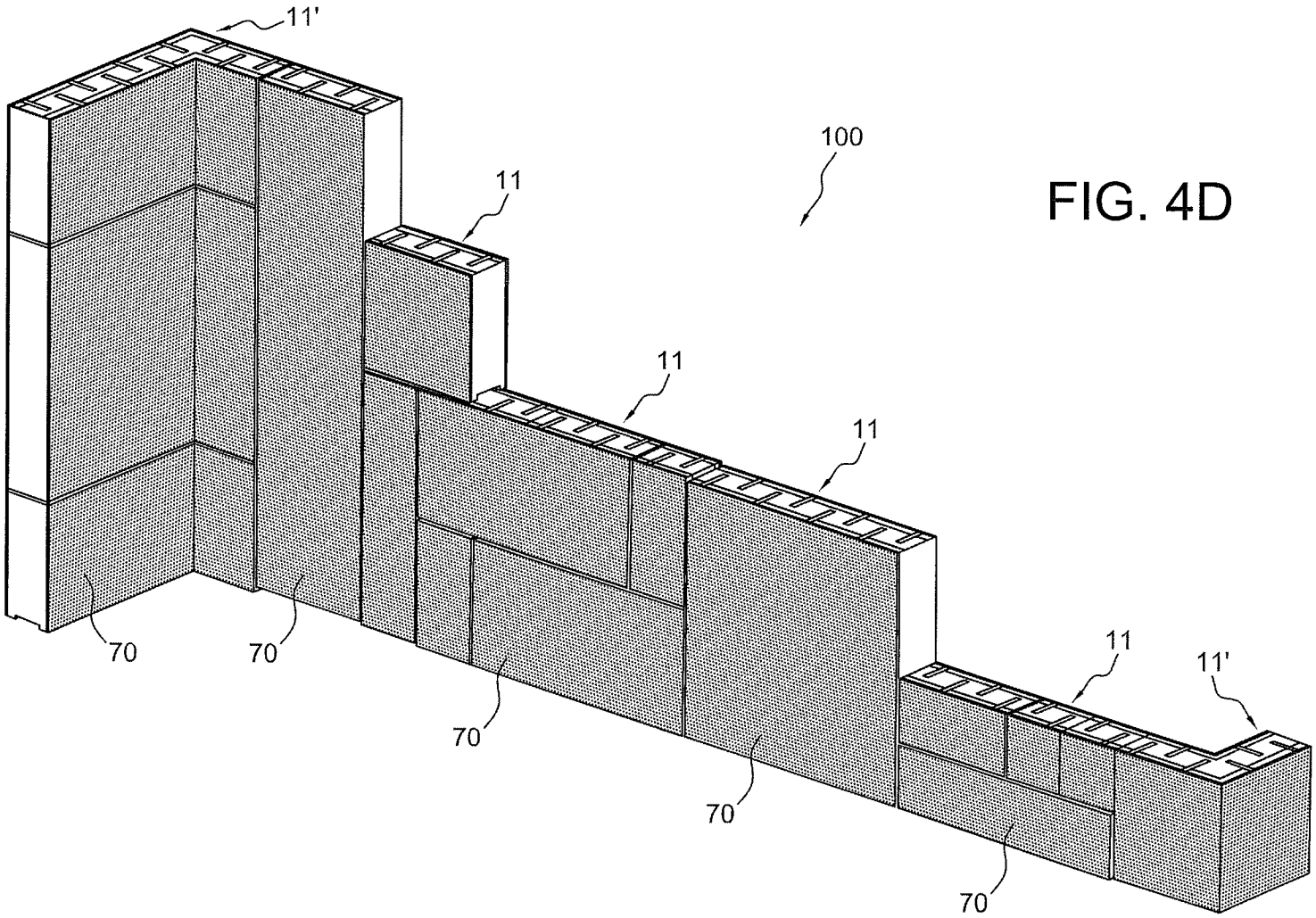

Reference is now made to FIGS. 4*b-d* which show examples of a further embodiment of the present invention in the form of a building blocks 11' which extend in two planes which join to form a corner with a desired angle. Even more alternatively one can imagine building blocks 11' extending in more than two planes to form further variants.

Reference is now made to FIGS. 4*a-d* which show details of a further embodiment of the present invention. According to this embodiment is either upper side of the building block 11, lower side of the building block 11 or both upper and lower side of the building block 11 provided with a longitudinal recess 33 adapted for accommodating a top sill 82 or support beam 84 or groundsill 80 (depicted in greater detail in FIGS. 6*a*-8*b*). In such an embodiment, the recesses 32 for reinforcing elements 40 will be arranged at inside of the recesses 33. By assembly of such embodiments the reinforcing elements 40 can be integrated with the recesses 32 and drainage channel 60, 60*a-c* and drainage holes 61*a-d* in the sill itself, and that the side pieces of the sill contains balancing pieces of insulation as a general sill. In other words, the top sill 82 or support beam 84 will be provided with a female part 41 or male part 42, as described above, so that the sill/beam can use the click-system, as described above, at fastening to a building block 11.

The above described embodiments provide a building block 11 which has as low weight as possible and where side plates or cover plates 70 can be arranged later and even be replaced, at the same time as it constitutes a load-bearing structure for the building itself, as opposed to prior art where the building blocks/wall elements are load-bearing for themselves and where the side plates/cover plates are forming the load-bearing construction. The building block according to the present invention further exhibits both high vertical and horizontal strength, and is torsional stable. Accordingly, the building block 11, 11' according to the present invention exhibit a stable and solid building block 11, 11' which in addition has so low weight that it can be handled by one person.

When a wall construction 100 is to be erected with building blocks 11, 11' according to the present invention it will be preferable to arrange a groundsill 80 at the concrete wall or concrete surface, to which the groundsill 80 is fixed. With the shown building block 11, 11', in the form of a bottom block, is ensured correct assembly of the bottom blocks and accordingly further building blocks 11, 11' arranged to the bottom blocks. Also here it will preferable that the reinforcing elements 40 are integrated together with recesses 32 and drainage channel 60, 60*a-c* and drainage holes 61*a-d* in the groundsill 80 itself, and that the side pieces of the groundsill 80 includes balancing pieces of insulation as a general beam. In other words, the groundsill 80 can be provided with a female part 41 or male part 42, as described above, so that the groundsill 80 can use the click-system described above at fastening to a building block 11. The bottom block 11 can then be fixed to the groundsill 80 by means of the above described click-system, and it will be preferable to apply a gently expanding glue before assembling the bottom block to the groundsill 80.

In connection with windows and doors in a building there are preferably arranged building blocks 11 exhibiting a centrally extending recess 33 at the upper side of the building block 11 at each side of the window or door (depicted in greater detail in FIGS. 7*a*-8*b*), such that a support beam 84 can be arranged to the building blocks and extending over and under, respectively, the door/window and therethrough the construction becomes solid and the pressure load is balanced over and under the doors/windows. The recess 33 is preferably half as deep as the height of the support beams 84. In this way, one again over these building block 11, can arranged building blocks 11 of the type bottom blocks, as described above under FIG. 4*a*, which have a recess at the underside which is half of the height of the support beams 84 and therethrough the building blocks 11 will be integrated with the support beams 84. The support beams 84 are fastened by means of the above described click-system, and in addition preferably gently expanding glue.

Alternatively the building blocks 11, 11' can be fixed with through screws and gently expanding glue to each other or sills/beams, if the reinforcing elements 40/sills/beams are not provided with a click-system.

Figures 5A, 5B:
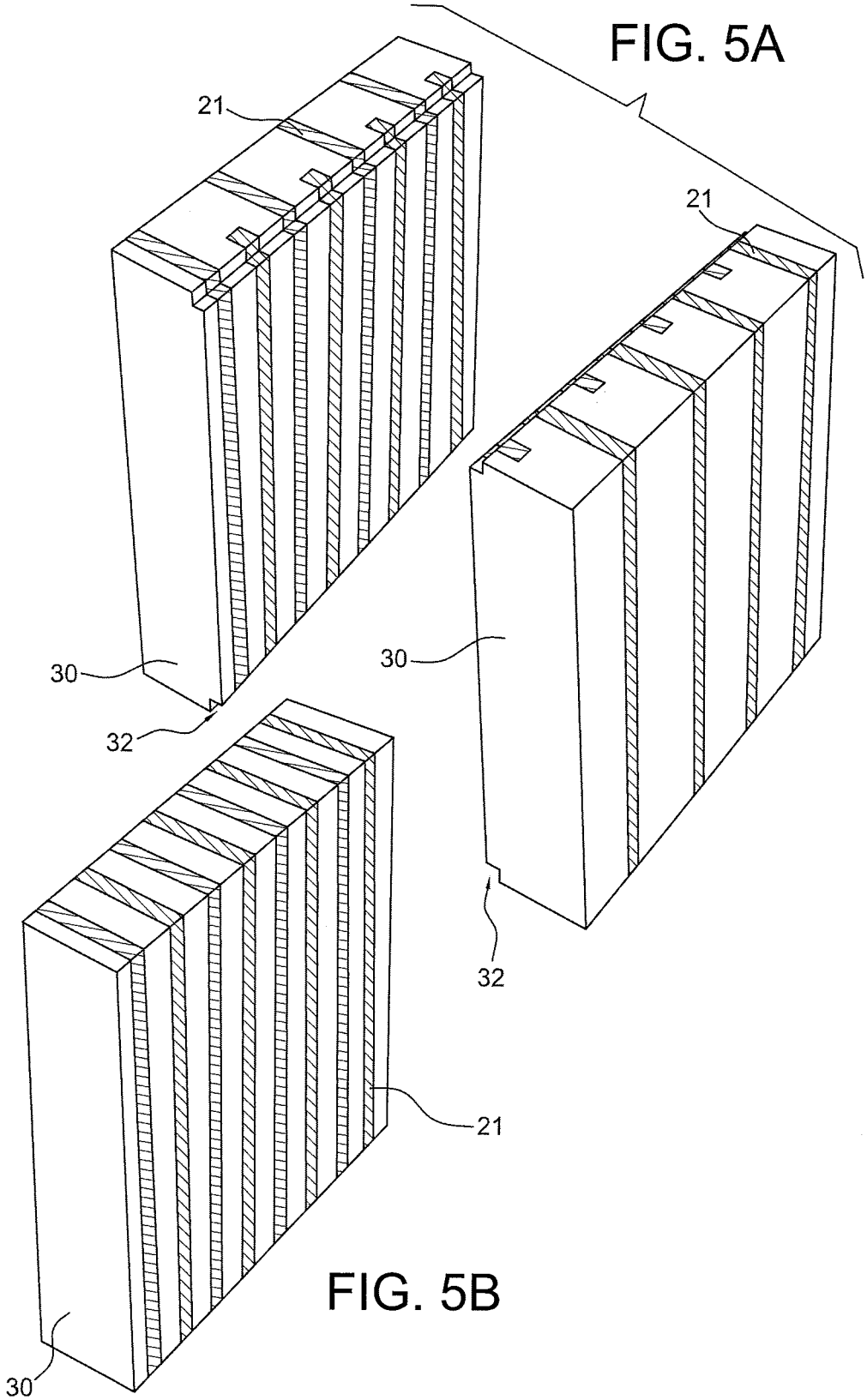
FIG. 5*a-b* show different embodiments of a building block for special adaption, FIG. 6 show a building block provided with recesses for use of an alternative lock mechanism for arrangement of building blocks to each other.

Reference is now made to FIGS. 5*a-b* which show building blocks 11 according to a further embodiment of the present invention in the form of adaption blocks. The adaption blocks are formed in the same way as the above described embodiments of the building blocks 11, but in addition they are divided in two, so that they in a simple manner can be arranged at terminations against existing roof or framework, where there is arranged a top sill 82. By that the adaption blocks are divided in two this enables that they can be arranged from each side against a top sill 82 and in this way complete a wall construction 100. The adaption blocks will then be fixed by that screws are inserted into the top sill 82 through the longitudinal sides 12, 13. As one can see from FIG. 5*a* the adaption blocks can be provided with a longitudinal recess/notch 33 adapted for arrangement against the top sill 82. In FIG. 5*b* it is shown a different solution where the adaption block instead of recess/notch has a shorter width. It should be noted that if it is desirable with additional reinforcing and strength for a wall formed by building blocks according to the present invention one can at desired positions arrange support beams 84 by using the above mentioned bottom and top blocks.

In other words, by the present invention it is provided building blocks 11 which has low weight, but which at the same time exhibit strength and insulation which can be adapted for use both for internal and outer walls, for non-loadbearing walls and load-bearing walls. The building blocks 11 will when they are arranged together, by that they include inner load-bearing walls, provide a construction which satisfies all demands for load-bearing constructions for arrangement of roofs, partitions between floors, and further floors above that again. The building block further exhibits both vertical and horizontal strength, and they are torsional stable. By that one have building blocks with different shapes which enables easy assembling against groundsill 80, top sill 82 and support beams 84, it is provided a building system of building blocks which can easily be adapted at the actual building site. By that the building blocks also can be formed with an extension in several planes this makes it easy to form correct corners. Another advantage with the present invention is that one can use building blocks adapted for later arrangement of side plates/cover plates with different height or length, for therethrough to achieve different design or shape or form of a wall or building. The building block can easily be divided/cut according to desired length, something which makes it easy to adapt for possible windows or doors, and completion against other walls.

The insulating material 30 of the building block 11 can consist of different layers with different properties, e.g. can one part of the insulating material be fire resisting or sound resisting or other relevant properties.

Further, the insulating material 30 on one side of the building block can extend some further and the at the other side some shorter, seen in the longitudinal direction of the building block 11, for therethrough to exhibit a tongue and groove function.

The reinforcing elements 40, i.e. the female part and/or male part can be provided with a tongue and groove function.

In FIG. 6 it is shown an alternative embodiment for fastening building blocks together in the form of the use of a specially adapted locking element which corresponds to a shortened embodiment of the above described male part 42 for the click-system of the reinforcing element 40. By arranging recesses 201 at upper and lower side, respectively, of the building block 11, so that when two building blocks 11 are assembled, the locking element will secure the building blocks 11 together, either in horizontal direction or in vertical direction or in both directions. The locking will then be as described above. This solution is especially relevant at the use of reinforcing elements 40 without click-system.

What is claimed is:

1. Building block (11) for forming a wall construction (100), which building block (11) includes insulating material (30) and vertical load-bearing walls (21) extending from one longitudinal side (12, 13) of the building block (11) and towards another longitudinal side (12, 13) of the building block (11), where the insulating material (30) is provided with recesses (31) for accommodating the load-bearing walls (21) for holding them in position, characterized in that an inner part of the insulating material (30) and load-bearing walls (21) are provided with recesses (32) for accommodating at least one longitudinal reinforcing element (40) binding the load-bearing walls (21) together in a longitudinal direction of the building block (11) for forming an inner core (20) where the load-bearing walls (21), insulating material (30) and the at least one reinforcing element (40) together form the basic load-bearing in the building block (11), and that the building block (11) includes at least one outer core (50) formed by parts of the insulating material (30) and the load-bearing walls (21) outside the at least one reinforcing element (40), where the at least one outer core (50) has supplementing and reinforcing properties for the inner core (20), characterized by that the building block (11) is provided with a centrally longitudinal recess (33) at a lower side adapted for accommodating a groundsill (80) or support beams (84), provided with a centrally longitudinal recess (33) at an upper side for accommodating a top sill (82) or support beam (84), or at both upper side and underside, where recesses (32) for longitudinal reinforcing elements (40) are arranged inside the centrally longitudinal recess (33).

2. Building block according to claim 1, characterized by that the outer core(s) (50) of the building block (11) form(s) together or separately on each side of the inner core (20) stabilization for the inner core (20) where the torsional effect and the vertical forces are further reinforced for the inner core (20) of the building block (11).

3. Building block according to claim 1, characterized in that the at least one reinforcing element (40) extends over groups of load-bearing walls (21) at one side of the building block (11) and/or extends over several groups of load-bearing walls (21) from both sides of the building block (11).

4. Building block according to claim 3, characterized in that the at least one longitudinal reinforcing element (40) extends over load-bearing walls (21) overlapping each other in the inner core (20) from both sides of the building block (11).

5. Building block according to claim 1, characterized by that load-bearing walls (21) of the building block (11) are arranged in a pattern of load-bearing walls (21) being dividable in two.

6. Building block according to claim 1, characterized in that building block (11) is provided with recesses (32) for reinforcing elements (40) and reinforcing elements (40) at both upper side and underside of the building block (11).

7. Building block according to claim 1, characterized in that the load-bearing walls (21) are fixed to the insulating material (30) by means of gently expanding glue or that the load-bearing walls (21) are embedded within the insulating material (30).

8. Building block according to claim 1, characterized in that the load-bearing walls (21) have an extension:

in a plane perpendicular to the longitudinal direction of the building block (11), or in a plane having an inclined angle in relation to the longitudinal direction of the building block (11).

9. Building block according to claim 8, characterized in that the load-bearing walls (21) from one side of the building block (11) have a longer extension than load-bearing walls (21) from the other side of the building block (11).

10. Building block (11) for forming a wall construction (100), which building block (11) includes insulating material (30) and vertical load-bearing walls (21) extending from one longitudinal side (12, 13) of the building block (11) and towards another longitudinal side (12, 13) of the building block (11), where the insulating material (30) is provided with recesses (31) for accommodating the load-bearing walls (21) for holding them in position, characterized in that an inner part of the insulating material (30) and load-bearing walls (21) are provided with recesses (32) for accommodating at least one longitudinal reinforcing element (40) binding the load-bearing walls (21) together in a longitudinal direction of the building block (11) for forming an inner core (20) where the load-bearing walls (21), insulating material (30) and the at least one reinforcing element (40) together form the basic load-bearing in the building block (11), and that the building block (11) includes at least one outer core (50) formed by parts of the insulating material (30) and the load-bearing walls (21) outside the at least one reinforcing element (40), where the at least one outer core (50) has supplementing and reinforcing properties for the inner core (20), characterized in that the building block (11) is provided with at least one longitudinal drainage channel (60, 60*a-b*) arranged in connection with the recesses (32) for the reinforcing elements (40), which drainage channel (60, 60*a-b*) are provided with drainage holes (61*a-d*) extending to each side of the building block (11).

11. Building block (11) for forming a wall construction (100), which building block (11) includes insulating material (30) and vertical load-bearing walls (21) extending from one longitudinal side (12, 13) of the building block (11) and towards another longitudinal side (12, 13) of the building block (11), where the insulating material (30) is provided with recesses (31) for accommodating the load-bearing walls (21) for holding them in position, characterized in that an inner part of the insulating material (30) and load-bearing walls (21) are provided with recesses (32) for accommodating at least one longitudinal reinforcing element (40) embedded within the insulating material (30) binding the load-bearing walls (21) together in a longitudinal direction of the building block (11) for forming an inner core (20) where the load-bearing walls (21), insulating material (30) and the at least one reinforcing element (40) together form the basic load-bearing in the building block (11), and that the building block (11) includes at least one outer core (50) formed by parts of the insulating material (30) and the load-bearing walls (21) outside the at least one reinforcing element (40), wherein the at least one outer core (50) has supplementing and reinforcing properties for the inner core (20) and the reinforcing elements (40) are formed by two parts in the form of a female part (41) and a male part (42) which are arranged in the recesses (32), which female part (41) and male part (42) are adapted for mutual engagement for forming a click-system.

12. Building block (11) for forming a wall construction (100), which building block (11) includes insulating material (30) and vertical load-bearing walls (21) extending from one longitudinal side (12, 13) of the building block (11) and towards another longitudinal side (12, 13) of the building block (11), where the insulating material (30) is provided with recesses (31) for accommodating the load-bearing walls (21) for holding them in position, characterized in that an inner part of the insulating material (30) and load-bearing walls (21) are provided with recesses (32) for accommodating at least one longitudinal reinforcing element (40) embedded within the insulating material (30) binding the load-bearing walls (21) together in a longitudinal direction of the building block (11) for forming an inner core (20) where the load-bearing walls (21), insulating material (30) and the at least one reinforcing element (40) together form the basic load-bearing in the building block (11), and that the building block (11) includes at least one outer core (50) formed by parts of the insulating material (30) and the load-bearing walls (21) outside the at least one reinforcing element (40), wherein the at least one outer core (50) has supplementing and reinforcing properties for the inner core (20) and the at least one reinforcing element (40) is provided with fastening means for forming fastening points for side plates or cover plates (70) and that the insulating material (30) is provided with a through hole or tube (72) for accommodating corresponding fastening means (71) arranged to the side plates or cover plates (70), where the fastening means of the reinforcing element (40) and fastening means of the side plates or cover plates (70) are provided with a click-system for mutual fastening.

* * * * *